US008807213B2

(12) United States Patent
Walker et al.

(10) Patent No.: US 8,807,213 B2
(45) Date of Patent: Aug. 19, 2014

(54) PRESSURE LIMITING DEVICE FOR WELL PERFORATION GUN STRING

(75) Inventors: Jerry L. Walker, Azle, TX (US); Corbin S. Glenn, Burleson, TX (US); Bryan D. Powell, Corinth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/879,313

(22) PCT Filed: Jun. 14, 2012

(86) PCT No.: PCT/US2012/042551

§ 371 (c)(1),
(2), (4) Date: Apr. 12, 2013

(87) PCT Pub. No.: WO2013/187905

PCT Pub. Date: Dec. 19, 2013

(65) Prior Publication Data

US 2014/0131097 A1 May 15, 2014

(51) Int. Cl.

| | |
|---|---|
| ***E21B 43/117*** | (2006.01) |
| ***E21B 43/11*** | (2006.01) |
| ***E21B 43/116*** | (2006.01) |
| ***E21B 29/02*** | (2006.01) |
| ***E21B 43/119*** | (2006.01) |

(52) U.S. Cl.

CPC ..... *E21B 29/02* (2013.01); *E21B 43/11* (2013.01); *E21B 43/116* (2013.01); *E21B 43/119* (2013.01)

USPC ..... 166/259; 175/2; 89/1.15

(58) Field of Classification Search

USPC ..... 166/259; 175/2; 89/1.15; 102/306, 323

See application file for complete search history.

(56) References Cited

U.S. PATENT DOCUMENTS

| | | | | |
|---|---|---|---|---|
| 4,753,170 | A * | 6/1988 | Regalbuto et al. | 102/305 |
| 5,088,557 | A | 2/1992 | Ricles et al. | |
| 6,095,247 | A | 8/2000 | Streich et al. | |
| 6,158,511 | A * | 12/2000 | Wesson | 166/308.1 |
| 7,600,568 | B2 | 10/2009 | Ross et al. | |
| 2004/0129415 | A1 | 7/2004 | Xi et al. | |
| 2007/0277966 | A1 | 12/2007 | Ross et al. | |
| 2011/0209871 | A1 | 9/2011 | Le et al. | |

FOREIGN PATENT DOCUMENTS

WO 2013187905 A1 12/2013

OTHER PUBLICATIONS

Foreign Communication from a Related Counterpart Application, International Search Report and Written Opinion dated Feb. 25, 2013, International Application Serial No. PCT/US12/42551, filed on Jun. 14, 2012.

Fisheer, S.H. and Grubelich, M.C., "A Survey of Combustible Metals, Thermites, and Intermetallics for Pyrotechnic Applications", Presented at the 32nd AIAA/ASME/SAE/ASEE Joint Propulsion Conference, Lake Buena Vista, FL, Jul. 1-3, 1996, 15 pages.

* cited by examiner

*Primary Examiner* — Cathleen Hutchins

(57) ABSTRACT

A perforation gun. The perforation gun comprises a tool body, the tool body defining at least one shouldered hole wherein the shouldered hole comprises a hole through a wall of the tool body and a shoulder that is thinner than the wall of the tool body and at least one perforating explosive charge disposed within the tool body.

20 Claims, 4 Drawing Sheets

PRESSURE LIMITING DEVICE FOR WELL PERFORATION GUN STRING

CROSS-REFERENCE TO RELATED APPLICATIONS

This application claims priority under 35 U.S.C. §371 to and is the National Stage of International Application No. PCT/US2012/042551 entitled, "Pressure Limiting Device for Well Perforation Gun String", filed on Jun. 14, 2012, by Jerry L. Walker et al., which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun or perforation tool. A packer may be set and a formation proximate to the wellbore may be hydraulically fractured. A plug may be set in the wellbore.

Perforation tools may comprise explosive charges that are detonated to fire the perforation tool, perforate a casing if present, and create perforations and/or tunnels into a subterranean formation proximate to the wellbore. In general, a perforating explosive charge may perforate a casing, a subterranean formation, or both. In some circumstances, it may be desirable that the tunnels created in the subterranean formation be deep and as free of debris as possible to promote flow of fluids into or out of the subterranean formation. Different explosive charges may be used to realize different perforation objectives. For example, big-hole explosive charges may produce holes in the casing and formation that are relatively bigger in diameter and relatively shallower than deep-penetrating explosive charges. Deep-penetrating explosive charges may produce holes in the casing and formation that are relatively smaller in diameter and relatively deeper than big-hole explosive charges. Sometimes a perforation gun may employ both big-hole charges and deep-penetrating charges. Yet other kinds of perforating explosive charges may be used in perforation tools.

Debris may comprise fines released from the subterranean formation or created by the perforation and/or residue from the perforation tool, for example, metal shards blown out of the perforation tool by the explosive charges. Debris may also be deposited in the wellbore as the perforation tool is removed from the wellbore, for example metal shards in the interior of the perforation gun falling or bouncing out of holes in the tool body of the perforation gun as the perforation gun is removed from the wellbore.

SUMMARY

In an embodiment, a perforation gun is disclosed. The perforation gun comprises a tool body, the tool body defining at least one shouldered hole wherein the shouldered hole comprises a hole through a wall of the tool body and a shoulder that is thinner than the wall of the tool body and at least one perforating explosive charge disposed within the tool body.

In an embodiment, a perforation gun string is disclosed. The perforation gun string comprises a perforation gun comprising at least one explosive charge, wherein the perforation gun comprises an interior chamber, a pressure relieving device that comprises an interior chamber, coupled to the perforation gun such that the interior chamber of the perforation gun is in communication with the interior chamber of the pressure relieving device, wherein a wall of the pressure relieving device defines a through hole, and a plug installed in the through hole in the wall of the pressure relieving device, wherein the plug is configured to unblock the through hole in the wall of the pressure relieving device in response to a pressure wave created by the detonation of the explosive charge in the perforation gun and communicated from the interior chamber of the perforation gun to the interior chamber of the pressure relieving device.

In an embodiment, a method of perforating a wellbore is disclosed. The method comprises detonating an explosive charge of a perforation gun in a perforation gun string and increasing a venting area of the perforation gun string in response to detonation of the explosive charge, wherein the venting area is greater than an area that would be formed by the explosive charge perforating a tool body of the perforation gun.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
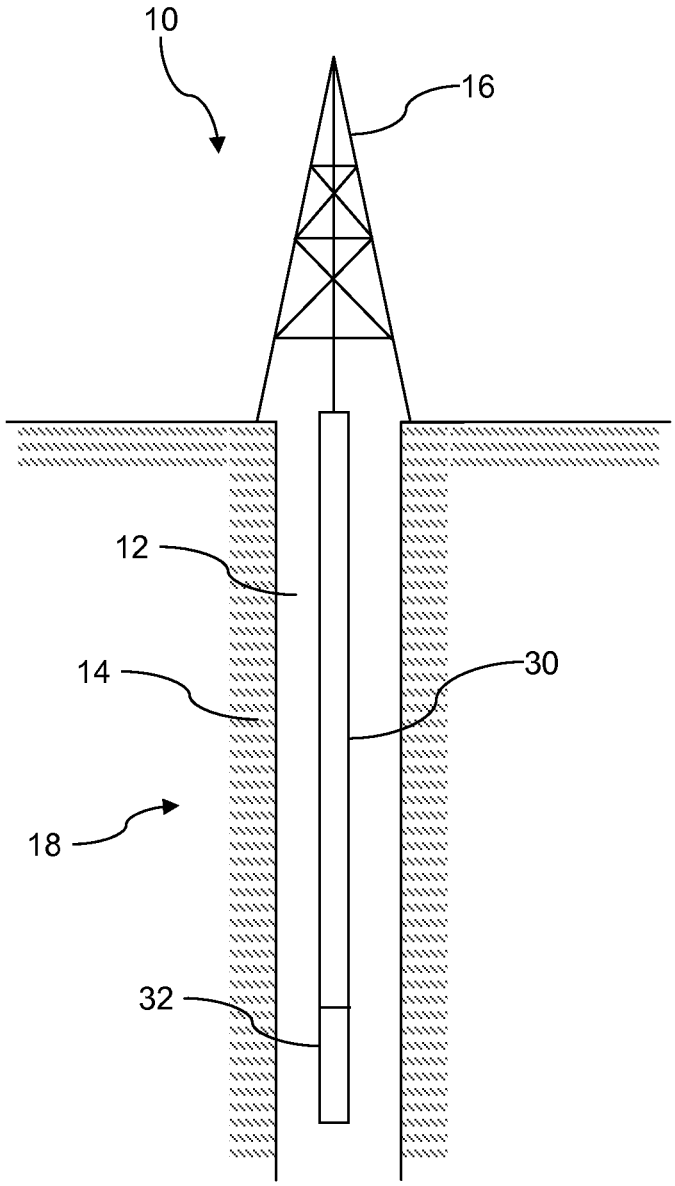
FIG. 1 is an illustration of a wellbore, a conveyance, and a perforation tool according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to inner or outer will be made with reference to an inside of a perforation gun and/or a perforation gun string and an outside of the perforation gun and/or perforation gun string. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

When perforation gun explosive charges are detonated, a pressure wave is created in an interior of the perforation gun and/or a perforation gun string that includes the perforation gun. In some test cases, this pressure wave has been observed to cause the tool body of the perforation gun to rupture and/or to burst. It is possible that such damage of the tool body may increase debris left in the wellbore by perforation. It is possible that such damage of the tool body may cause the perforation gun and/or perforation gun string to become stuck in the wellbore, entailing expensive recovery operations or even well abandonment. The present disclosure discloses mechanisms to dampen, attenuate, or otherwise reduce the pressure wave produced in the interior and/or interior chamber of the perforation gun and/or the perforation gun string. This may be referred to as limiting or reducing the pressure in the interior of the perforation gun and/or the perforation gun string.

In an embodiment, a through hole is created in the tool body or wall of the perforation gun and/or a subassembly of the perforation gun string that is plugged during run-in of the perforation gun but that becomes unplugged at the time the pressure wave is created in the interior of the perforation gun and/or perforation gun string. In an embodiment, the through hole has a bigger diameter than is typically created in the tool body by the detonation of an explosive charge, for example a bigger diameter than would typically be produced by detonating a deep-penetrating charge or by detonating a big-hole charge. The through hole may be plugged with a frangible material such as ceramic, glass, or a frangible metal. The through hole may be plugged by a reactive metal or a reactive metal group that may partly combust in reaction to the explosive energy.

In an embodiment, a deep-penetrating explosive charge may be located so that its focused energy is directed out the through hole and/or coaxially aligned with the through hole. When the deep-penetrating explosive charge is detonated, the focused explosive energy fractures the plug, the energy passes out the through hole to perforate the casing in the wellbore and the formation. The pressure wave that is created by the detonation of the deep-penetrating explosive charge may be dampened, attenuated, and/or reduced because the pressure is able to vent more effectively out the through hole that is larger than the standard hole created by a deep-penetrating explosive charge. The plug may be placed in a shouldered hole in the tool body of the perforation gun. The plug may be positioned an incremental distance further away from the deep-penetrating explosive charge than would be the tool body of the prior art that does not have a through hole, and this incrementally greater stand-off distance may improve the ability of the deep-penetrating charge to focus its explosive energy. An improved focus of the explosive energy may provide for improved deep penetration of the formation. This configuration may also be utilized with a big-hole explosive charge.

In an embodiment, a plugged through hole may be provided in the tool body of the perforation gun away from the axis of focus of the explosive charge or in a wall of a subassembly of the perforation gun string, for example in a tandem. The plug placed in the through hole, in this embodiment, may be fractured by the pressure wave resulting from the detonation of one or more explosive charges in the perforation gun, and the opening of the through hole thereby increases the venting area of the interior of the perforation gun and/or the interior of the perforation gun string, thereby dampening, attenuating, or reducing the pressure wave. In another embodiment, the plug may not be frangible but may simply drop to the end of the wellbore or be retained by a tether attached to the perforation gun and/or the perforation gun string.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure and supports a workstring 18 in the wellbore 12, but in other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a perforation gun string 32, and other tools and/or subassemblies (not shown) located above or below the perforation gun string 32. The conveyance 30 may comprise any of a string of jointed pipes, a slickline, a coiled tubing, a wireline, and other conveyances for the perforation gun string 32. In an embodiment, the perforation gun string 32 comprises one or more explosive charges that may be triggered to explode, perforating a casing if present, perforating a wall of the wellbore 12 and forming perforations or tunnels out into the formation 14. The perforating may promote recovering hydrocarbons from the formation 14 for production at the surface, storing hydrocarbons flowed into the formation 14, or disposing of carbon dioxide in the formation 14, or the like.

Figure 2A:
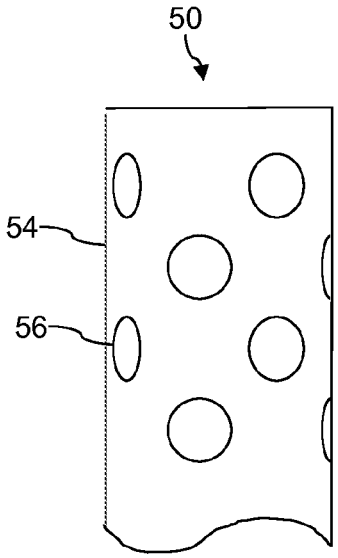
FIG. 2A is an illustration of a perforation gun according to an embodiment of the disclosure.

Turning now to FIG. 2A, a perforation gun 50 is described. In an embodiment, the perforation gun 50 comprises a tool body 54 that defines one or more shouldered holes 56. In some contexts, the tool body 54 may be referred to as a wall of the perforation gun 50, an outer wall of the perforation gun 50, or a gun barrel of the perforation gun 50. As used herein, a shouldered hole comprises a countersunk hole of a first diameter that does not go through a wall of the tool body 54 (or other wall, such as a wall of a subassembly or tandem) and a concentric through hole of a second diameter, where the second diameter is less than the first diameter, that does go through the wall of the tool body 54. As illustrated in FIG. 2B that shows a top view and in FIG. 2C that shows a side view, in an embodiment, the shouldered hole 56 comprises a through hole 62 and a countersunk hole 64. The countersunk hole 64 has a first diameter 58, and the through hole 62 has a second diameter 60, where the second diameter 60 is less than the first diameter 58. The shouldered hole 56 defines a shoulder 65. In some contexts, the shoulder 65 may be referred to as a lip, a race, or a channel.

Figure 2D:
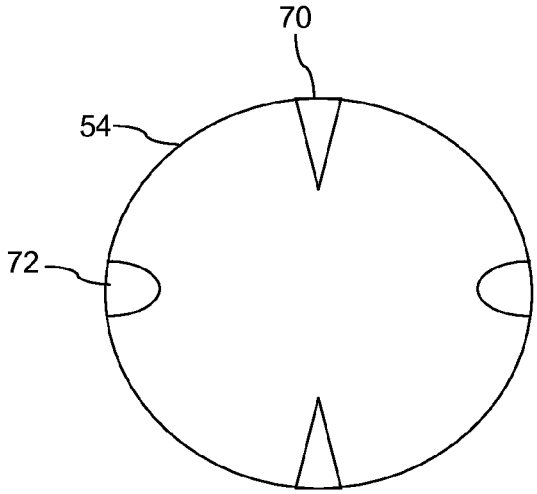
FIG. 2D is an illustration of explosive charges in relation to a tool body of a perforation gun according to an embodiment of the disclosure.
Figure 2B:
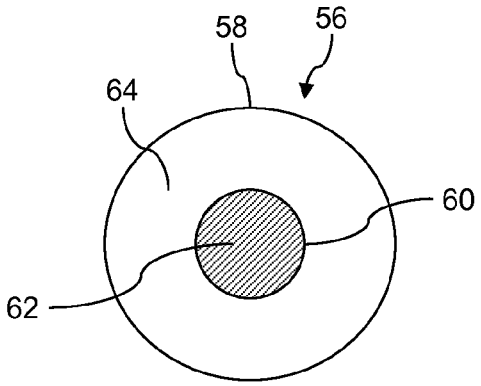
FIG. 2B is a top view of a shouldered hole according to an embodiment of the disclosure.

Turning now to FIG. 2D, the perforation gun 50 may further comprise one or more explosive charges, for example one or more deep-penetrating explosive charges 70 and/or one or more big-hole explosive charges 72. While the descriptions hereinafter may refer to deep-penetrating charges and big-hole charges, the perforation gun 50 may comprise other types of perforating explosive charges that are neither deep-penetrating charges nor big-hole charges, and it is understood that the teachings of the present disclosure may be applied to other types of explosive charges and/or perforation charges. In an embodiment, the perforation gun 50 may comprise one or more deep-penetrating explosive charges 70 and zero big-hole explosive charges 72; the perforation gun 50 may comprise one or more big-hole explosive charges 72 and zero deep-penetrating explosive charges 70; or the perforation gun 50 may comprise a mix of both deep-penetrating explosive charges 70 and big-hole explosive charges 72.

As is known to those skilled in the art, a big-hole charge is a perforating charge designed to create perforations with a large-diameter entrance hole. The big-hole charges may create a larger diameter entrance hole at the cost of a reduced penetration depth of the overall perforation tunnel in the formation. In an embodiment, a big-hole charge may make a hole of about ½ inch in the tool body 54. In other embodiments, however, the big-hole charge may make a different sized hole in the tool body 54. Big-hole charges may be used in a variety of operations including, but not limited to, sand and gravel pack completions in high-permeability formations, completions that are to be followed by hydraulic fracturing, and/or completions using a combination of hydraulic fracturing and gravel packing, which are commonly referred to as a frac-pack operation.

As is known to those skilled in the art, a deep-penetrating charge is a perforating charge designed to provide a long perforation tunnel into the formation. The deep-penetrating charge may create a longer perforation tunnel at the cost of a small to medium sized entrance hole, which may be used with a higher shot density (e.g., as measured by shots per foot of wellbore) to compensate for the reduced entrance hole size relative to the big-hole charges. In an embodiment, a deep-penetrating charge may make a hole about 0.35 inch in diameter in the tool body 54. In another embodiment, however, the deep-penetrating charge may make a different sized hole in the tool body 54. Deep-penetrating charges may be used in a variety of operations including, but not limited to, operations in which near-wellbore damage exists and the perforation tunnels need to extend through the damage, and/or low permeability formations. In an embodiment, the deep-penetrating charges may produce a more intense pressure wave or a higher maximum pressure in an interior of the perforation gun 50 and/or perforation gun string than would big-hole charges. In some contexts, the interior of the perforation gun 50 may be referred to as an interior chamber of the perforation gun 50 and/or an interior chamber of the tool body 54.

Figure 2E:
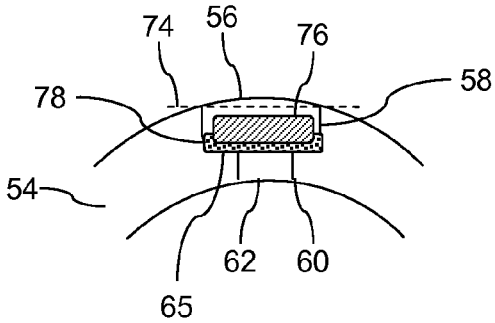
FIG. 2E is an illustration of a plug and through hole in a tool body of a perforation gun according to an embodiment of the disclosure.
Figure 2C:
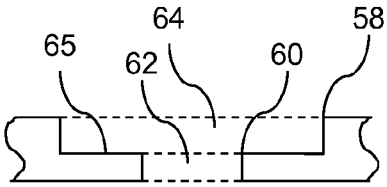
FIG. 2C is a side view of a shouldered hole according to an embodiment of the disclosure.

In an embodiment, an explosive charge may be located inside the tool body 54 with an axis of the explosive charge aligned with about the center of the shouldered hole 56. For example a charge carrier retaining the charges 70, 72 inside the tool body 54 may position the deep-penetrating charge 70 so its focus of explosive energy is directed out the through hole 62. Turning now to FIG. 2E, a plug 76 may be placed in the countersunk hole 64 to seal the through hole 62 to prevent in-flow of fluids to the interior of the perforation gun 50. Dotted line 74 indicates a flush level from one edge to another edge of the shouldered hole 56. The plug 76 may be supported on the shoulder 65 of the shouldered hole 56 and retained by a polymeric and/or curable component 78 (e.g., a resin or an epoxy). Alternatively, the plug 76 may be retained by an adhesive. It is understood that an epoxy may be considered to be an adhesive, but materials that are not an epoxy also may be used to provide an adhesive (the term 'adhesive' comprehends more than just epoxies). Alternatively, in an embodiment, the plug 76 may be sized to be installed in the countersunk hole 64 with a press fit. Alternatively, the plug 76 may be retained in the countersunk hole 64 by retaining hardware such as a split ring or spring biased pins that engage corresponding holes. The plug 76 may be retained in the countersunk hole 64 by bolts, screws, rivets, or other attaching hardware. In an embodiment, an O-ring, gasket, or other sealing device may be located between the plug 76 and the shouldered hole 56 to prevent fluid passing around the plug 76 and into the interior of the perforation gun 50. The shape of the plug may be optimized to facilitate debris size, breakup, or pressure rating (scored, segmented, arched, domed, etc.).

In an embodiment, the plug 76 may be formed of a material that is molded into the shouldered hole 56. For example, the inside of the shouldered hole 56 may be sealed by a tape or other thin barrier; a plug material may be flowed into the shouldered hole 56; and the plug material may harden or cure.

In an embodiment, the material forming the plug 76 may be applied directly into the shouldered hole 56 through the use of a mold, or the shouldered hole 56 may be configured substantially as a mold. In this process, the surface of the shouldered hole 56 may be optionally prepared using any known technique to clean and/or provide a suitable surface for bonding the plug material into the shouldered hole 56. The attachment surface may be prepared by sanding, sand blasting, bead blasting, chemically treating the surface, heat treating the surface, or any other treatment process to produce a clean surface for applying the plug material in the shouldered hole 56. In an embodiment, the preparation process may result in the formation in the shouldered hole 56 of one or more surface features such as corrugation, stippling, or otherwise roughening of the surface, on a microscopic or macroscopic scale, to provide an increased surface area and suitable surface features to improve bonding between the surface of the shouldered hole 56 and the plug material.

The optionally prepared surface may then be covered with an injection mold. The injection mold may be suitably configured to retain the plug material in the desired position and provide the plug 76 with an appropriate height. The injection mold may be provided with an adhesive on a surface of the mold that contacts the shouldered hole 56. It will be appreciated that the adhesive described in this disclosure may comprise any suitable material or device, including, but not limited to, tapes, glues, and/or hardenable materials such as room temperature vulcanizing silicone. The injection mold may be sealed against the shouldered hole 56. Following such general sealing against the shouldered hole 56, the plug material may be introduced into a space between the injection mold and the shouldered hole 56 using a port disposed in the injection mold. The plug material may flow throughout the mold and form the plug 76.

The plug material may be allowed to harden and/or set. For example, heat may be applied to thermally activate a thermally setting resin, or allowing a sufficient amount of time for the curing of the plug 76. After the plug 76 has sufficiently hardened and/or set, the injection mold may be unsealed from the shouldered hole 56. In an embodiment, a plurality of plug materials may be used with multiple injection periods to produce a desired plug 76.

In an embodiment, the through hole 62 is sized to be larger than a typical sized hole created by a perforating charge (e.g., a deep-penetrating charge). For example, the through hole 62 may be about 0.375 inches in diameter, about 0.4 inches in diameter, about 0.425 inches in diameter, about 0.475 inches in diameter, about 0.5 inches in diameter, about 0.525 inches in diameter, about 0.55 inches in diameter, or some other diameter. It is also possible that the through hole 62 may be sized to be larger than the typical sized hole created by a big-hole charge. For example, the through hole 62 may be about 0.575 inches in diameter, about 0.6 inches in diameter, about 0.625 inches in diameter, about 0.65 inches in diameter, or some other diameter. While in present designs the relatively higher peak pressure that may occur during detonation of deep-penetrating explosive charges 70 may entail greater risks of rupture of the tool body 54, particularly when a densely packed constellation of deep-penetrating explosive charges 70 are installed in the perforation gun 50, as designs evolve and big-hole explosive charges 72 become more powerful, the risks of rupture of the tool body 54 may likewise increase in perforation guns 50 having some or many big-hole explosive charges 72. Thus, it is contemplated that the teachings of the present disclosure may be used with big-hole explosive charges 72 and/or perforation guns 50 that comprise a significant number of big-hole explosive charges 72. This same consideration applies to other types of perforating explosive charges.

In an embodiment, it is desirable that the through hole 62 be larger than the hole typically created by the deep-penetrating charge 70 when penetrating a tool body 54 without a through hole 62. A larger diameter through hole 62 is associated with an increase in the venting area of the tool body 54, which may be desirable. However, a larger venting area may also be associated with increased opportunity for debris within the interior of the perforation gun 50 to escape and litter the wellbore 12, which is an undesirable result. In practice, there is a balance that may be struck between increasing the venting area sufficiently to avoid rupturing the perforation gun 50 and not increasing the venting area to the point where debris inside the perforation gun 50 escapes too easily. In combination with the present disclosure, one skilled in the art will be able to determine this balance between increasing venting area sufficiently to avoid damaging and/or rupturing the tool body 54 but not excessively increasing the venting area. This determination may take into consideration the mix of explosive charges (e.g., the mix of big-hole charges 72 and deep-penetrating charges 70) in the perforation gun 50.

In an embodiment, some of the deep-penetrating charges 70 are located proximate to a shouldered hole 56 so the axis of their explosive energy focus is substantially coaxial with the through hole 62, while others of the deep-penetrating charges 70 may be located proximate to a standard scallop in the tool body 54. As is known to one skilled in the art, a scallop in the tool body of a perforation gun is a region where the metal is scooped out, milled out, cut out, or otherwise removed to create a thinner cross section of metal aligned with the explosive focus of the explosive charge, promoting the ease of perforation of the tool body by the explosive charge. In an embodiment, the big-hole charges 72 are located proximate to standard scallops in the tool body 54. Alternatively, some of the big hole charges 72 may be located proximate to a shouldered hole 56 so the axis of their explosive energy focus is substantially coaxial with and directed outwards through the through hole 62.

Placing the deep-penetrating charges 70 proximate to a shouldered hole 56 so the axis of the explosive energy focus is substantially coaxial with the through hole 62 and directed out the through hole 62 may increase a stand-off distance of the deep-penetrating charge 70 and promote increased and/or more effective focusing and/or concentration of the explosive energy released during detonation of the deep-penetrating charge 70. The improved focus of the explosive energy may improve the ability to deeply penetrate the subterranean formation 14. Likewise, less of the energy of the deep-penetrating charge 70 may be expended in getting out the through hole 62 of the shouldered hole 56 of the perforation gun 50 than is expended perforating a standard scallop in the tool body 50, thereby leaving more of this energy available for deeper penetration of the subterranean formation 14.

The plug 76 may be comprised of frangible material. As commonly understood, frangible implies readily or easily broken. As used in the context of the present application, frangible may refer to materials that break, fragment, and/or shatter when subjected to an explosion or to a high pressure differential. The frangible material may be sturdy enough to resist shocks and bumps associated with running the perforation gun 50 into the wellbore 12 and other ordinary accelerations and shocks experienced prior to the detonation of the charges 70, 72. When explosive energy is focused upon the frangible material or a pressure wave within the interior of the perforation gun 50 is incident on the frangible material, the frangible material may break, thereby opening the through hole 62 of the shouldered hole 56 and thereby increasing the venting area of the perforation gun 50. By increasing the venting area of the perforation gun 50, the pressure wave in the interior of the perforation gun 50 may be dampened or attenuated, and the likelihood of the tool body 54 rupturing may be reduced. This may be referred to as limiting the pressure within the perforation gun 50. The plug 76 may be comprised of frangible metal. The plug 76 may be comprised of ceramic material and/or glass material.

The plug 76 may be comprised of composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. In a particle-based composite, particles may act as the reinforcing agent. The matrix material may act to keep the fibers and/or particles in a desired location and orientation and also serve as a load-transfer medium between fibers and/or particles within the composite.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material.

When fibers are used as the reinforcing agent, the fibers may lend their characteristic properties, including their strength-related properties, to the composite. Fibers useful in the composite materials used to form the plug 76 may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof. When particles are used as the reinforcing agent, the particles, likewise, may lend their characteristic properties to the composite. In an embodiment, a mixture of fibers and particles may be used as the reinforcing agent. The ratio of fibers to particles in the reinforcement agent of the composite and/or the ratio of reinforcement agent to matrix materials in the composite may be adjusted to achieve the desired properties of the plug 76: tough and durable when running into the wellbore 12 and during normal downhole operations; frangible under the high pressure load of a perforation event.

The strength of the interface between the reinforcement agent and the matrix material may be modified or enhanced through the use of a surface coating agent. The surface coating agent may provide a physico-chemical link between the reinforcement agent and the resin matrix material, and thus may have an impact on the mechanical and chemical properties of the final composite. The surface coating agent may be applied to the reinforcement agent during their manufacture or any other time prior to the formation of the composite material. Suitable surface coating agents may include, but are not limited to, surfactants, anti-static agents, lubricants, silazane, siloxanes, alkoxysilanes, aminosilanes, silanes, silanols, polyvinyl alcohol, and any combinations thereof.

In an embodiment, the plug 76 may be comprised of a non-frangible material such that when the explosive charge 70, 72 detonates, the plug 76 is expelled out of the shouldered hole 56, remaining intact. When the non-frangible plug 76 is expelled from the shoulder hole 56, the through hole 62 is unplugged, and the venting area of the perforation gun 50 is increased. After perforation of the wellbore 12, the expelled plug 76 may be fished out of the wellbore 12 with fishing tools. Alternatively, the expelled plug 76 may be left at the bottom of the wellbore 12. Alternatively, in an embodiment, the plug 76 may be tethered to the interior of the tool body 54 and removed from the wellbore 12 when removing the perforation gun 50. An embodiment of a tethered plug is described further below with reference to FIG. 3C and FIG. 3D.

In an embodiment, the plug 76 may be comprised of one or more reactive materials, and when the explosive charge 70, 72 directs its explosive energy upon the plug 76 comprised of one or more reactive materials, the reactive materials combust, the through hole 62 is unblocked, and the venting area of the tool body 54 is increased. A plug 76 may comprise two reactive materials that comprise a reactive group: a pair of materials that are specifically reactive when combined with each other under selected environmental conditions, for example environmental conditions of high pressure and/or high temperature. The plug 76 may be formed by pressing together powdered metals that make a reactive group, the green strength property holding the plug 76 together.

A variety of reactive groups may be selected for use in fabricating the plug 76, for example tantalum and tungsten dioxide may be combined to fabricate the plug 76. The reactive group materials may comprise thermite mixtures, intermetallic reactants, and/or other reactants. Generally, a thermite is a mixture of a metal and an oxidizer, for example a metal oxide, that react to give off heat under specific conditions, for example when triggered by heat and/or pressure. Some thermite reactive groups, however, may comprise a metal and a non-metallic oxide, for example aluminum (Al) and silicon dioxide ($SiO_2$) can undergo a thermitic reaction. Generally, intermetallic reactants comprise selected pairs of metals that react together under specific conditions, for example when triggered by heat and/or pressure. Some intermetallic reactive groups, however, may comprise a metal and a non-metal, for example boron (B) and silicon (Si) can undergo an intermetallic reaction. As an alternative way of understanding intermetallic reactive groups, under some conditions some chemists may consider boron, carbon, and silicon to be metallic or to behave under subject conditions in a manner that a metal would. Some of the reactive group materials may comprise pairs of materials that, when in intimate contact and effectively stimulated by high temperature and/or high pressure, react energetically with each other. The reactive group materials may comprise nickel paired with aluminum and/or tantalum paired with aluminum. The reactive group materials may comprise tantalum and an oxidizer, for example tantalum paired with iron oxide ($Fe_2O_3$), tantalum paired with copper oxide ($Cu_2O$), and/or tantalum paired with tungsten dioxide ($WO_2$).

The reactive group materials may comprise neodymium and an oxidizer, for example neodymium paired with lead oxide (for example, $PbO_2$ or $Pb_3O_4$). It is understood that other reactive group materials not explicitly enumerated above are also contemplated by the present disclosure. For further enumeration of reactive group materials, see *A Survey of Combustible Metals, Thermites, and Intermetallics for Pyrotechnic Applications*, a paper by S. H. Fischer and M. C. Grubelich, presented at the 32$^{nd}$ AIAA/ASME/SAE/ASEE Joint Propulsion Conference, Lake Buena Vista, Fla., Jul. 1-3, 1996, which is hereby incorporated in its entirely by reference for all purposes. The reaction efficiency of some reactant pairs, for example the nickel-aluminum reactive group, may be sensitive to the stoichiometric mix of the reactants and/or the homogeneity of the mix of the reactants. The relative quantities of the reactants may be selected to assure an effective stoichiometric mix of the reactants.

Figure 3A:
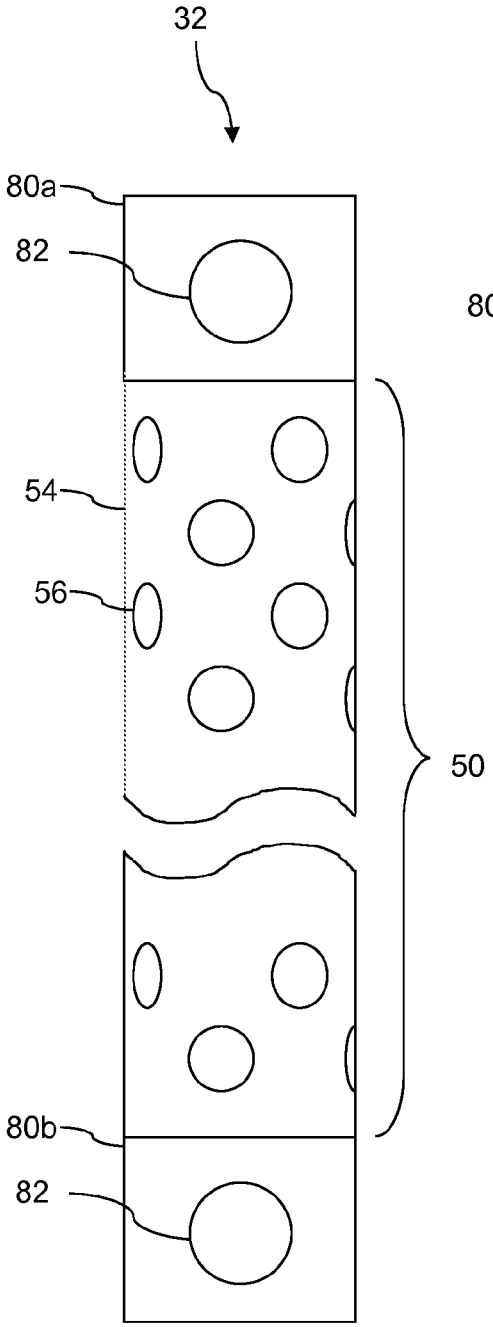
FIG. 3A is an illustration of a perforation gun string according to an embodiment of the disclosure.

Turning now to FIG. 3A, the perforation gun string 32 is described. In an embodiment, the perforation gun string 32 comprises a first subassembly 80*a*, the perforation gun 50, and a second subassembly 80*b*. In other embodiments, the perforation gun string 32 may comprise other numbers of subassemblies 80. Further, it is understood that the perforation gun string 32 may comprise any number of perforation guns 50 and that the perforation guns 50 may have a variety of different configurations. The perforation gun string 32 may comprise gun strings 50 that are different from each other. For example, a first perforation gun 50 may comprise a different mix of deep-penetrating charges 70 and big-hole charges 72 than a second perforation gun 50. The length of the first perforation gun 50 may be different from the length of the second perforation gun 50. The perforation gun string 32 may comprise a variety of subassemblies including tandems, packers, control modules, logging tools, and other devices or tools.

The subassemblies 80 may have an interior that communicates with the interior of the perforation gun 50 and/or with the interior of the tool body 54. The interior of the subassemblies 80 may be referred to in some contexts as an interior chamber of the subassemblies 80. In an embodiment, one or more of the subassemblies 80 may have a shouldered hole 82. The shouldered hole 82 may be substantially similar to the hole described above with reference to FIG. 2B and FIG. 2C.

Figure 3B:
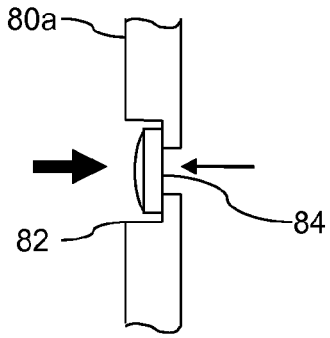
FIG. 3B is an illustration of a plug in a through hole in a perforation gun string according to an embodiment of the disclosure.
Figure 3C:
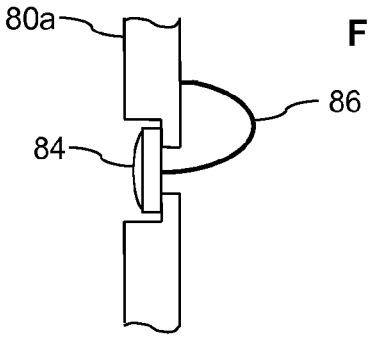
FIG. 3C is an illustration of a tethered plug in a through hole in a perforation gun string according to an embodiment of the disclosure.
Figure 3D:
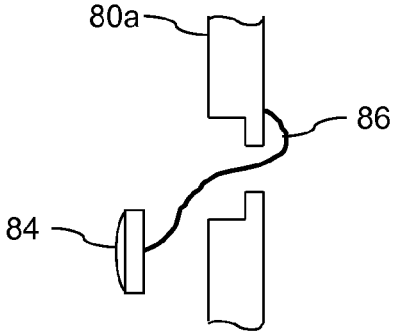
FIG. 3D is an illustration of a tethered plug outside of a through hole in a perforation gun string according to an embodiment of the disclosure.
Figure 3E:
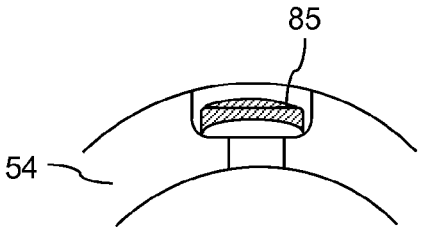
FIG. 3E is an illustration of a plug having a domed inner surface and domed outer surface and through hole in a tool body of a perforation gun according to an embodiment of the disclosure.

Turning now to FIG. 3B, FIG. 3C, and FIG. 3D, a domed plug 84 in relation to the shouldered hole 82 is described. In an embodiment, the domed plug 84 has a convex side that faces the exterior of the subassembly 80. The opposite side of the domed plug 84 may be flat. Alternatively, the opposite side of the domed plug 84 may be concave facing towards an interior of the subassembly 80, such as the domed plug 85 of FIG. 3E. In an embodiment, the domed plug 84. 85 is configured to sustain a relatively high differential pressure in a first sense directed from outside to inside the subassembly 80 and configured to sustain a relatively low differential pressure in a second sense directed from the inside to the outside of the subassembly 80. The heavy arrow in FIG. 3B notionally represents the high differential pressure directed from outside towards inside; the light arrow in FIG. 3B notionally represents the low differential pressure directed from inside towards outside.

The domed plug 84 may be comprised of any of the materials that the plug 76 may be comprised of, as described above. The domed plug 84 may be frangible or non-frangible. In an embodiment, the domed plug 84 may be coupled to the subassembly 80 by a tether 86, as illustrated in FIG. 3C and FIG. 3D. When the domed plug 84 is expelled from the shouldered hole 82, the domed plug 84 may be retained by the tether 86 so the domed plug 84 may be withdrawn from the wellbore 12 with the perforation gun string 32. The tether 86 may be a chain comprising links. The tether 86 may comprise a solid wire or metal bar that deforms and bends in response to the pressure incident upon the domed plug 84.

In an embodiment, the shouldered hole 82 may be plugged with a plug substantially like plug 76 described above, for example a plug that is not domed in shape. The shouldered hole 82 is not proximate to an explosive charge. The domed plug 84 is expelled or shattered by an incident pressure wave, for example a pressure wave in the interior of the perforation gun string 32 initiated by detonation of one or more explosive charges 70, 72 in one or more perforation guns 50. When the domed plug 84 is expelled or shattered, the venting area of the interior of the perforation gun string 32 is increased. By increasing the venting area of the interior of the perforation gun string 32, the pressure wave in the interior of the perforation gun 50 may be dampened or attenuated, and the likelihood of the tool body 54 rupturing may be reduced.

While illustrated in FIG. 3A as circular, the shouldered holes 56 and/or 82 may have any shape. In an embodiment, the shouldered hole 82 may have an elliptical shape, a rectangular shape, a rectangular shape with rounded corners, a slot shape, or other shape. The through hole associated with the shoulder hole 82, likewise, may have any other shape. In an embodiment, the shouldered hole 82 and domed plug 84 and optionally the tether 86 may be provided in the tool body 54 of the perforation gun 50, at a location not proximate to the explosive charge 70, 72. For example, the shouldered hole 82 and domed plug 84 may be located on an opposite side of the tool body 54 such that when the explosive charge 70, 72 detonates, the domed plug 84 is shattered, fragmented, and/or crushed by the pressure wave initiated by the detonation of the explosive charge 70, 72. The appropriate mix of explosive charges 70, 72 located proximate to scallops in the tool body 54; the mix of explosive charges 70, 72 located proximate to shouldered holes 56 and plugs 76 as described above with reference to FIG. 2B, FIG. 2C, FIG. 2E; the mix of shoulder holes 82 and domed plugs 84 in the tool body 54 and/or in the subassembly 80 may be determined, in combination with the present disclosure, by one of skill in the art.

In an embodiment, a perforation gun string 32 may be assembled and tested at a test facility to evaluate the suitability of the design. As is suggested further above, the design of a perforation gun string 32 incorporating shouldered holes 56 and plugs 76 and/or shouldered holes 82 and domed plugs 84 takes place in an environment of mutually opposing design criteria. Smaller through holes 62 promote less release of undesirable debris from the interior of the perforation gun string 32; but larger through holes 62 promote greater increase of venting area and further reduction of the possibility of the perforation gun 50 rupturing. In an embodiment, a perforation gun string 32 may be tested with slightly more powerful deep-penetrating explosive charges 70 than standard power. The design of the through hole 62 and the placement of the shouldered holes 56, 82 may be adjusted until just the point where the design is marginally free of perforation gun rupture. If this design is then manufactured with standard power deep-penetrating explosive charges 70 replacing the increased power deep-penetrating explosive charges 70 used in testing, the resultant production perforation gun string 32 should have a margin of safety from perforation gun rupture but not an excess margin that undesirably allows excess release of debris from the interior of the perforation gun string 32. Alternatively, other design and testing approaches may be applied.

Figure 4:
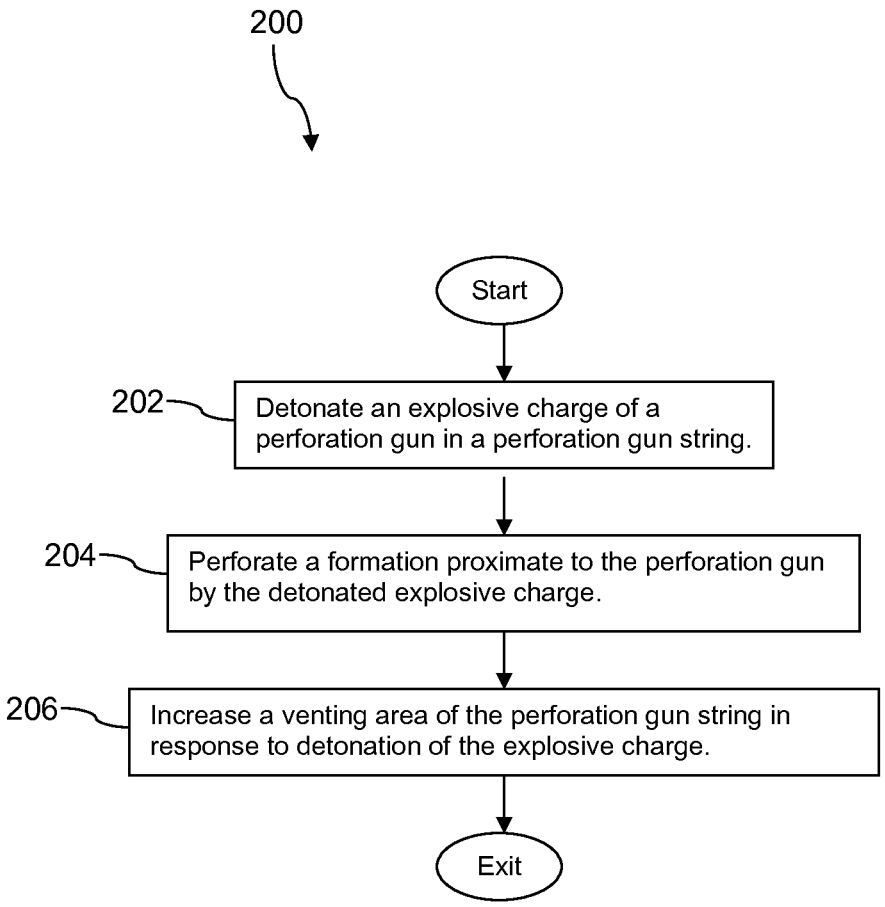
FIG. 4 is a flow chart of a method according to an embodiment of the disclosure.

Turning now to FIG. 4, a method 200 is described. At block 202, an explosive charge of a perforation gun in a perforation gun string is detonated. For example, one or more of the explosive charges 70, 72 in the perforation gun 50 in the perforation gun string 32 is detonated. At block 204, a formation proximate to the perforation gun may optionally be perforated by the detonated explosive charge. At block 206, a venting area of the perforation gun string is increased in response to the detonation of the explosive charge. For example, in response to the detonation of one or more explosive charge 70, 72 in the perforation gun 50 in the perforation gun string 32, a venting area of the interior of the perforation gun string 32 and/or the perforation gun 50 is increased. The venting area of the interior of the perforation gun string 32 may be increased by opening a through hole in the shouldered hole 56 and/or the shouldered hole 82. The through hole may be opened by expelling, breaking, shattering, fragmenting, and/or combusting the plug 76 and/or the domed plug 84, as described further above, caused by the detonation of the explosive charge 70, 72. It is understood that the blocks 202, 204, and 206 may occur in very close time proximity to each other, for example within 1 millisecond of each other or less.

After the perforation event described above, the perforation gun string 32 may be withdrawn or retrieved from the wellbore 12. If the plug 76, 84 is coupled to the perforation gun 50 and/or the perforation gun string 32 by tethers 86, those plugs may be withdrawn from the wellbore 12 with the perforation gun string 32. Alternatively, some or all of the plugs 76, 84 may remain in the wellbore 12. In an embodiment, a fishing tool may be coupled to the conveyance 30 after removal of the perforation gun string 32 from the wellbore 12; the fishing tool may be run into the wellbore 12; one or more of the plugs 76, 84 may be captured by the fishing tool; and the fishing tool as well as captured plugs 76, 84 may be retrieved from the wellbore 12. In an embodiment, the plugs 76, 84 may be pulverized and/or milled to reduce the size and/or granularity of the plugs 76, 84 by other downhole tools run-in with the conveyance 30 after retrieval of the perforation gun string 32.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A perforation gun, comprising:

a tool body having an interior chamber, the tool body defining at least one shouldered hole wherein the shouldered hole comprises a hole through a wall of the tool body and a shoulder that is thinner than the wall of the tool body, wherein shouldered hole comprises a cross-sectional area through the wall of the tool body;

at least one perforating explosive charge disposed within the tool body, wherein the perforating explosive charge has an axis of symmetry, the shouldered hole has an axis of symmetry, and the perforating explosive charge is aligned so the axis of symmetry of the perforating explosive charge substantially coincides with the axis of symmetry of the shouldered hole, wherein the at least one perforating explosive charge is configured to generate a focused explosive energy having a perforation area upon detonation, and wherein the cross-sectional area of the shouldered hole is greater than the perforation area of the at least one perforating explosive charge; and a plug disposed in the shoulder hole, wherein the plug is configured to unblock the hole through the wall of the tool body to provide a venting area greater than the perforation area in response to a pressure wave created by detonation of the explosive charge in the tool body and communicated from the interior chamber of the tool body through the hole.

2. The perforation gun of claim 1, wherein the plug is a frangible plug, wherein the frangible plug is disposed in the shouldered hole in a run-in configuration of the perforation gun.

3. The perforation gun of claim 2, wherein the frangible plug comprises at least one of ceramic material, glass material, frangible metal material, or a reactive metal material.

4. The perforation gun of claim 2, wherein the frangible plug is retained in the shouldered hole by an adhesive.

5. The perforation gun of claim 1, further comprising at least one explosive charge that is not axially aligned with a shouldered hole.

6. The perforation gun of claim 1, wherein the plug comprises a domed inner surface that faces the interior chamber of the tool body.

7. A perforation gun comprising:

a tool body comprising a first interior chamber, the tool body defining at least one shouldered hole wherein the shouldered hole comprises a hole through a wall of the tool body and a shoulder that is thinner than the wall of the tool body;

at least one perforating explosive charge disposed within the tool body, wherein the perforating explosive charge has an axis of symmetry, the shouldered hole has an axis of symmetry, and the perforating explosive charge is aligned so the axis of symmetry of the perforating explosive charge substantially coincides with the axis of symmetry of the shouldered hole;

a pressure relieving device that comprises a second interior chamber coupled to the tool body such that the first interior chamber of the tool body is in communication with the second interior chamber of the pressure relieving device, wherein a wall of the pressure relieving device defines a through hole; and a plug installed in the through hole in the wall of the pressure relieving device, wherein the plug is configured to unblock the through hole in the wall of the pressure relieving device in response to a pressure wave created by detonation of the explosive charge in the tool body and communicated from the interior chamber of the tool body to the interior chamber of the pressure relieving device.

8. The perforation gun of claim 7, wherein the pressure relieving device comprises one of a tandem or a subassembly.

9. The perforation gun of claim 7, wherein at least one of an outer surface of the plug is domed or an inner surface of the plug is domed.

10. The perforation gun of claim 7, further comprising a tether coupled to the pressure relieving device and coupled to the plug, wherein when the plug unblocks the through hole the tether is configured to retain at least a portion of the plug when the pressure relieving device is removed from a wellbore.

11. The perforation gun of claim 7, wherein the through hole is a shouldered hole.

12. The perforation gun of claim 7, wherein the through hole is substantially circular, is substantially oval, is substantially rectangular, or is rectangular with rounded corners.

13. The perforation gun of claim 7, wherein the tool body comprises at least one deep-penetrating explosive charge.

14. A method of perforating a wellbore, comprising:

detonating an explosive charge of a perforation gun in a perforation gun string, wherein the perforation gun includes:

a tool body that defines a through hole in a wall of the tool body, and a plug covering the through hole;

forming, within at least a portion of the perforation gun, a focused explosive energy having a perforation area, wherein the forming occurs in response to the detonating of the explosive charge;

removing at least a portion of the plug that is greater than the perforation area in response to the detonation of the explosive charge; and increasing a venting area of the perforation gun based on the removal of at least a portion of the plug that is greater than the perforation area, wherein increasing the venting area occurs in response to the detonation of the explosive charge.

15. The method of claim 14, wherein increasing the venting area of the perforation gun dampens a pressure wave within at least a portion of the perforation gun, wherein the pressure wave is created by the detonation of the explosive charge.

16. The method of claim 14, wherein removing at least a portion of the plug greater than the perforation area comprises opening the through hole in the wall of the perforation gun.

17. The method of claim 16, wherein opening the through hole comprises a pressure wave associated with the detonation of the explosive charge expelling, from the perforation gun, at least a portion of the plug covering the through hole.

18. The method of claim 16, wherein opening the through hole comprises a pressure wave associated with the detonation of the explosive charge shattering at least the portion of the plug covering the through hole that is greater than the perforation area, and wherein the plug is a frangible plug comprising at least one of ceramic material, glass material, frangible metal material, or a reactive metal material.

19. The method of claim 14, wherein the explosive charge comprises at least one of a deep-penetrating explosive charge or a big-hole explosive charge.

20. The method of claim 14, wherein the explosive charge has an axis of symmetry, wherein the shouldered hole has an axis of symmetry, and wherein the explosive charge is aligned so the axis of symmetry of the explosive charge substantially coincides with the axis of symmetry of the shouldered hole.

* * * * *